US010367301B2

(12) United States Patent
Suzuki et al.

(10) Patent No.: US 10,367,301 B2
(45) Date of Patent: Jul. 30, 2019

(54) LEVER-TYPE CONNECTOR

(71) Applicant: Sumitomo Wiring Systems, Ltd., Yokkaichi, Mie (JP)

(72) Inventors: Masakazu Suzuki, Mie (JP); Kazuo Nakai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/682,604

(22) Filed: Aug. 22, 2017

(65) Prior Publication Data

US 2018/0083386 A1 Mar. 22, 2018

(30) Foreign Application Priority Data

Sep. 16, 2016 (JP) ..... 2016-181336

(51) Int. Cl.
*H01R 13/422* (2006.01)
*H01R 13/629* (2006.01)

(52) U.S. Cl.
CPC ... *H01R 13/62955* (2013.01); *H01R 13/4223* (2013.01); *H01R 13/6295* (2013.01); *H01R 13/62938* (2013.01); *H01R 13/62977* (2013.01)

(58) Field of Classification Search
CPC ..... H01R 13/4223; H01R 13/62938; H01R 13/6295; H01R 13/62955
See application file for complete search history.

(56) References Cited

U.S. PATENT DOCUMENTS 7,419,390 B2 * 9/2008 Ohtaka ..... H01R 13/639 439/157
7,481,661 B2 * 1/2009 Takahashi ..... H01R 13/62933 439/157
9,124,033 B2 * 9/2015 Hirano ..... H01R 13/62955
9,812,813 B1 * 11/2017 Sakamoto ..... H01R 13/502
2011/0014805 A1 1/2011 Sakamaki et al.
2013/0065412 A1 * 3/2013 Ikeda ..... H01R 13/62938 439/157
2013/0228429 A1 * 9/2013 Henmi ..... H01R 13/62933 200/335
2013/0237078 A1 * 9/2013 Ikeda ..... H01H 9/102 439/157

(Continued)

FOREIGN PATENT DOCUMENTS

JP 2009-245609 10/2009

*Primary Examiner* — Edwin A. Leon
*Assistant Examiner* — Oscar C Jimenez
(74) *Attorney, Agent, or Firm* — Gerald E. Hespos; Michael J. Porco; Matthew T. Hespos

(57) ABSTRACT

A lever-type connector (A) includes a connector body (10). A lever (30) has a base end (32) rotatably supported on the connector body (10) and a rotating portion (34) for rotational operation is formed on a tip (33) of the lever (30). A finger contact surface (59) is disposed on an outer surface (58) of the rotating portion (34) and is configured to receive contact of a finger during a rotational operation. A resilient lock (51) is formed on the connector body (10) and is configured to lock the lever (30) in a rotation restricted state. Unlocking portions (53) are formed on the resilient lock (51) and are configured to press the resilient lock (51) in a direction separating from the lever (30). The unlocking portions (30) are exposed on the outer surface (58) of the lever (30) with the resilient lock (51) and the lever (30) locked together.

16 Claims, 15 Drawing Sheets

(56) References Cited

U.S. PATENT DOCUMENTS

| | | | | |
|---|---|---|---|---|
| 2014/0248788 | A1* | 9/2014 | Kodama | H01R 13/62938 439/310 |
| 2015/0064953 | A1* | 3/2015 | Iwatani | H01R 13/62933 439/341 |
| 2015/0111441 | A1* | 4/2015 | Suzuki | H01R 13/4223 439/871 |
| 2015/0295352 | A1* | 10/2015 | Kim | H01R 13/62938 439/157 |
| 2016/0379778 | A1* | 12/2016 | Ooishi | H01R 13/62938 200/51.09 |

* cited by examiner

LEVER-TYPE CONNECTOR

BACKGROUND

1. Field of the Invention

The invention relates to a lever-type connector.

2. Description of the Related Art

Japanese Unexamined Patent Publication No. 2009-245609 discloses a lever-type connector with a housing, a wire cover, a lever and a slider. The wire cover is configured to bend a wire drawn out from the housing. The lever is rotatable between an initial position and a connection position and the slider is configured to slide in conjunction with the lever. Rotation of the lever from the initial position to the connection position causes the mating connector to slide in contact with a cam groove of the slider and connects the mating connector to the housing. The lever is held at the connection position by a resiliently deformable lock formed on the wire cover. Rotation of the lever from the connection position to the initial position causes the lock to deform resiliently and to unlock by pressing an unlocking projection of the lock with a finger. The lever then is moved toward the initial position by pressing a rotating surface of a coupling of the lever while the finger is pressing the unlocking projection.

The rotating surface and the unlocking projection are arranged side by side while being spaced apart in a rotating direction of the lever. Thus, when pressing the rotating surface, a force pressing the unlocking projection may be relaxed and the lock member may resiliently return to effect locking again. In this case, the finger has to be returned to the unlocking projection and the unlocking operation has to be performed again. Thus, operability is not good.

Further, an unlocking surface to be pressed with the finger is a flat surface extending along the rotating direction of the lever. Thus, frictional resistance generated when the finger pressing the unlocking surface is shifted toward the rotating surface is large, and operability is not good.

The invention was completed based on the above situation and aims to improve operability in unlocking and rotating a lever.

SUMMARY

The invention is directed to a lever-type connector with a connector body and a lever. The lever has a base end rotatably supported on the connector body and a rotating portion on a tip of the lever. A finger contact surface is disposed on an outer surface of the rotating portion and is configured to receive contact of a finger when rotating the lever. A resilient lock is formed on the connector body and is configured to lock the lever in a rotation restricted state. An unlocking portion is formed on the resilient lock and is configured to press the resilient lock away from the lever.

The finger contact surface and the unlocking portion may be disposed on the outer surface of the rotating portion. Thus, the unlocking portion can be pressed with a finger held in contact with the finger contact surface. There is no possibility of relaxing a force pressing the unlocking portion when a transition is made from an unlocking operation to an operation of rotating the lever. Therefore, operational efficiency is excellent.

The finger contact surface and the unlocking portion may be adjacent to each other in a direction intersecting a rotating direction of the lever. Thus, the unlocking portion can be pressed with a finger held in contact with the finger contact surface. Again, there is no possibility of relaxing a force pressing the unlocking portion when a transition is made from an unlocking operation to an operation of rotating the lever. Therefore, operational efficiency again is excellent.

The unlocking portion may be in the form of a blade extending along a rotating direction of the lever. In this embodiment, the lever is rotated while the unlocking portion is pressed with one finger. However, frictional resistance between the blade-shaped unlocking portion and the finger is small. Therefore the finger pressing the unlocking portion can slide in the rotating direction while being kept in that pressing state, and operational efficiency again is good.

The finger contact surface may be a substantially flat surface extending along the rotating direction of the lever. According to this configuration, the finger contact surface has a larger frictional resistance than the blade-shaped unlocking portion and a finger is unlikely to slip. Therefore, operability is good when the rotation of the lever is started.

The unlocking portion may project through a through hole in the finger contact surface when the resilient lock piece and the lever are locked to each other. According to this configuration, the unlocking portion is adjacent to the finger contact surface. Therefore, a force pressing the unlocking portion is unlikely to be relaxed and locking is released reliably.

The rotating portion may be disposed to cover the resilient lock piece with the resilient lock piece and the lever locked to each other. According to this configuration, the resilient lock piece can be protected from the interference of external matter.

DETAILED DESCRIPTION

One specific embodiment of the invention is described with reference to FIGS. 1 to 15. Note that, in the following description, a left side in FIGS. 1 to 4 and 6 to 12 is defined as a front concerning a front-rear direction. Upper and lower sides shown in FIGS. 1 to 11, 13 and 14 are defined as upper and lower sides concerning a vertical direction.

Figure 3:
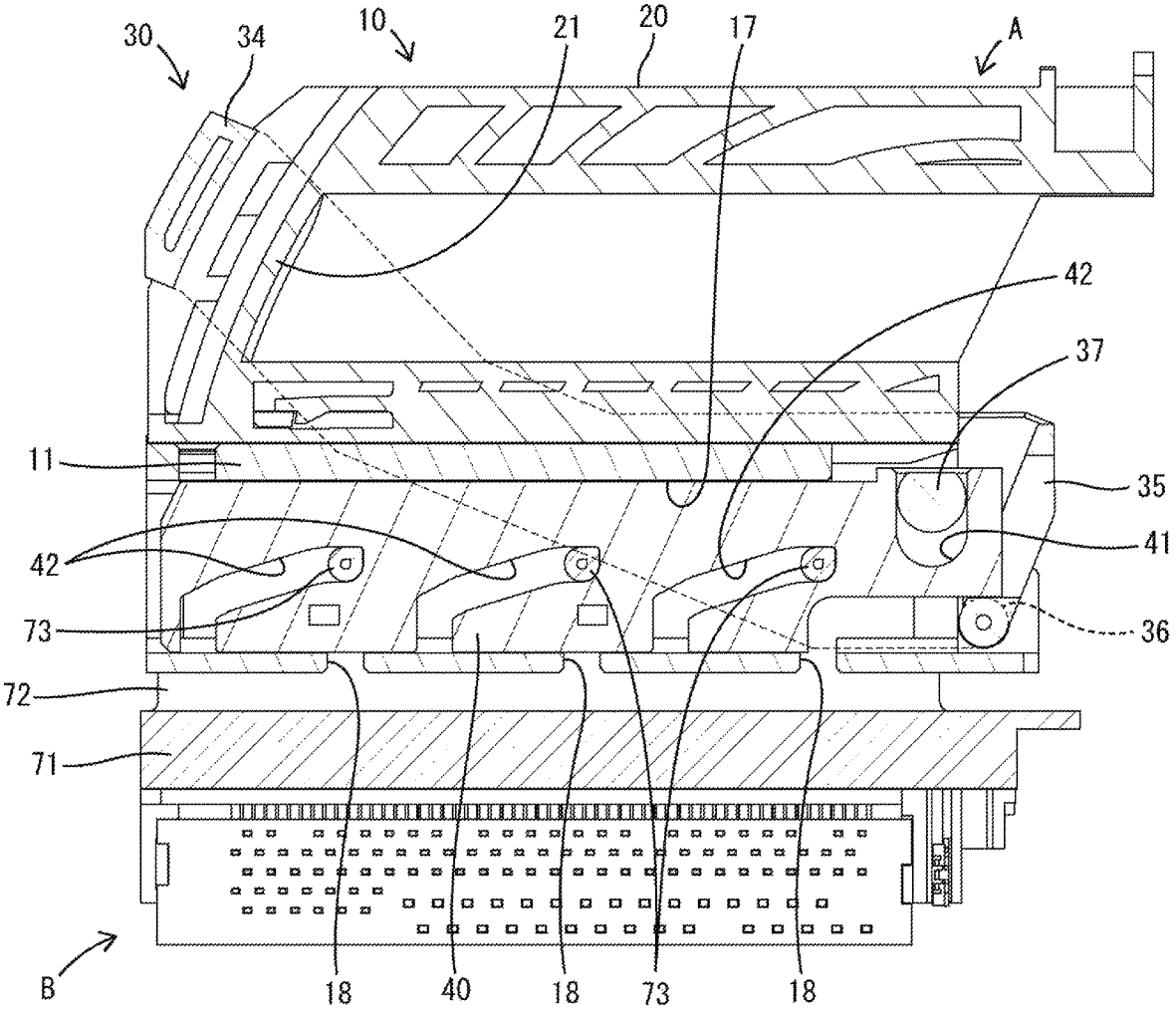
FIG. 3 is a side view in section showing a state where a lever-type connector and a mating connector are connected.
Figure 4:
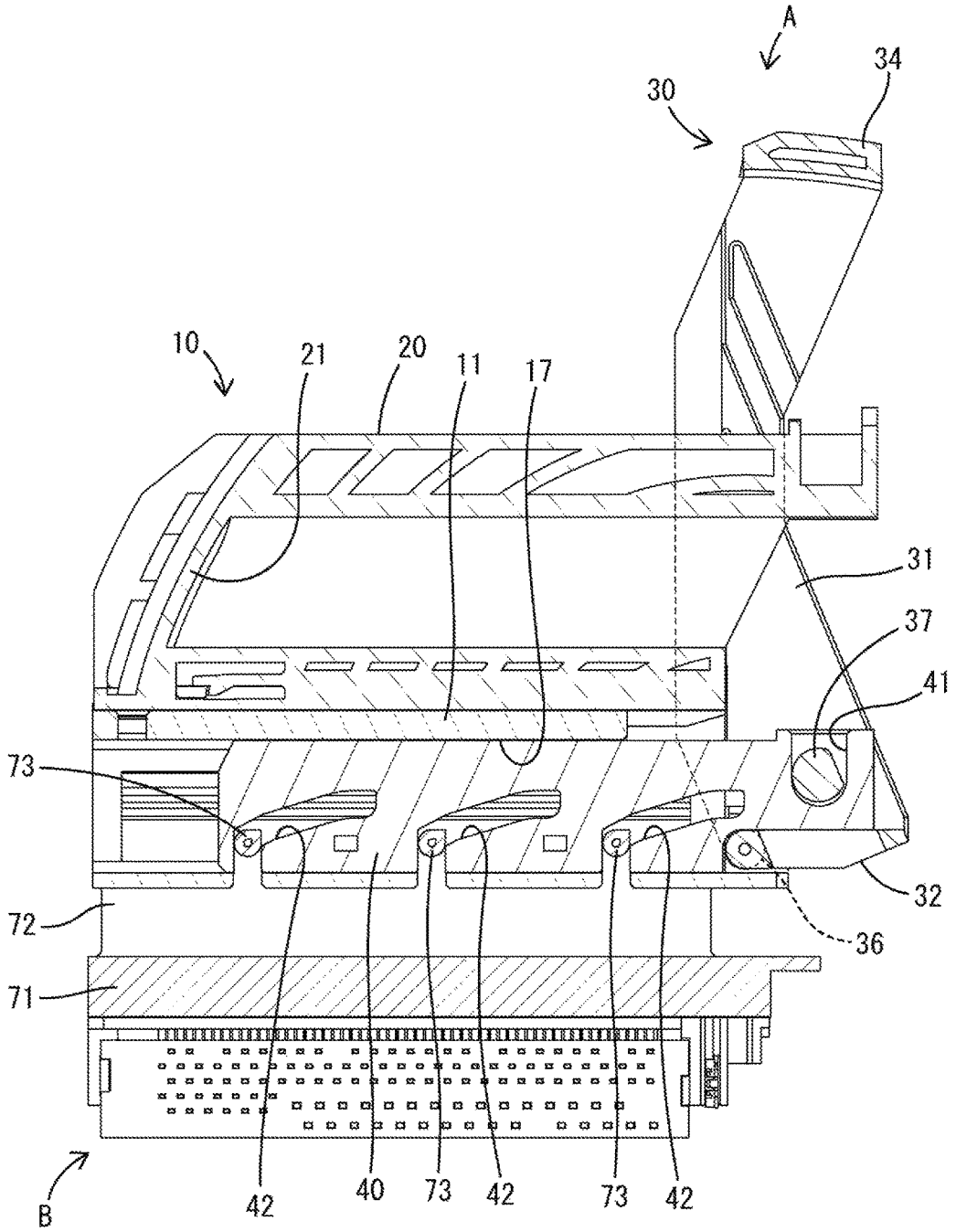
FIG. 4 is a side view in section showing a state where the connection of the lever-type connector and the mating connector is started.

A lever-type connector A of this embodiment has a booster mechanism and is connected to a mating male connector B. As shown in FIGS. 3 and 4, the mating connector B includes a mating housing 70 and male terminals (not shown) mounted in the mating housing 70. The mating housing 70 includes a receptacle 71 in the form of a rectangular tube long in the front-rear direction and open upward. Three cam followers 72 project from each of the left and right outer side surfaces of the receptacle 71 while being spaced apart in the front-rear direction. The lever-type connector A is connected to the mating connector B from above the mating connector B.

Figure 1:
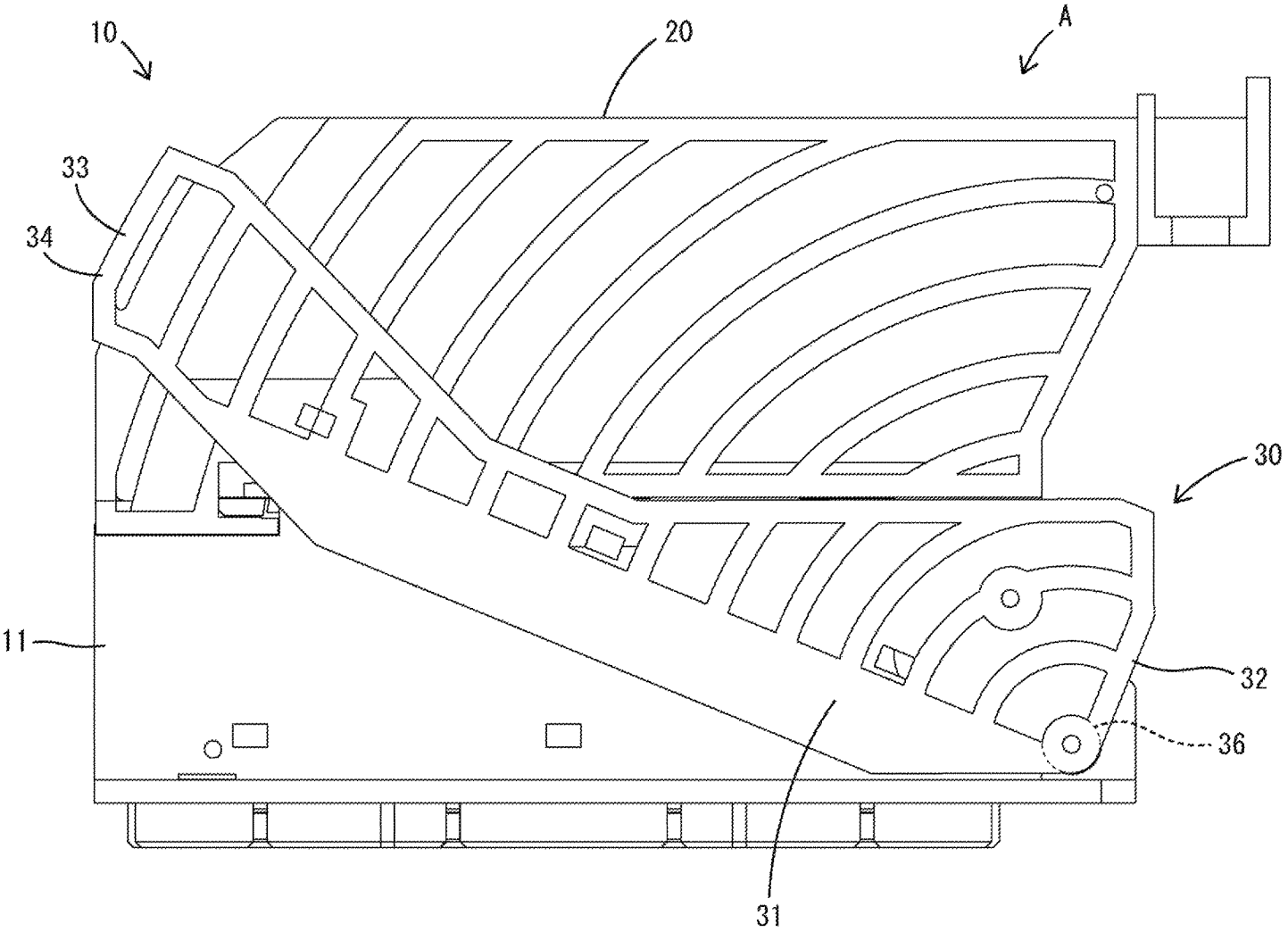
FIG. 1 is a side view showing a state where a lever is at a connection position in a lever-type connector of one embodiment.
Figure 2:
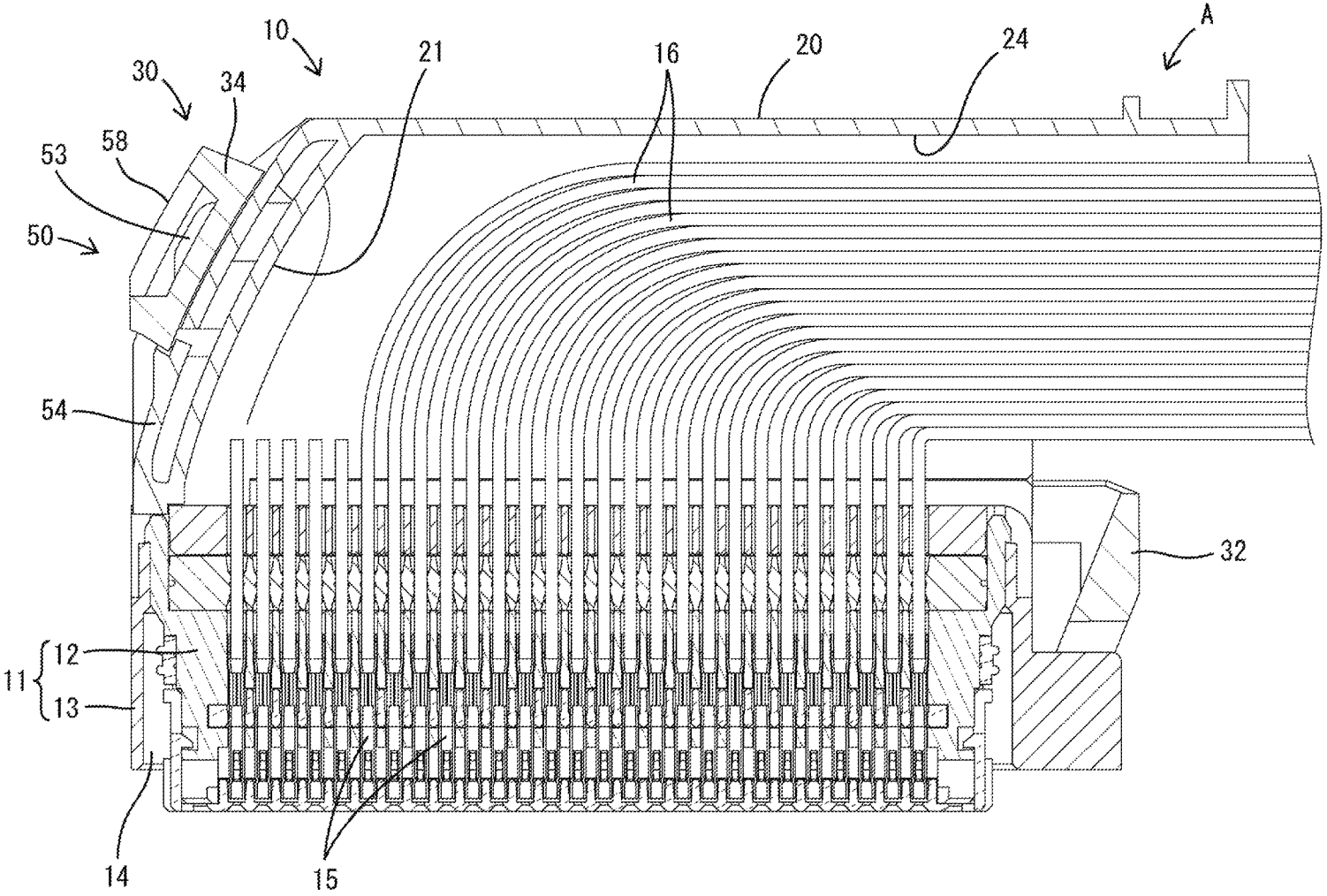
FIG. 2 is a side view in section showing the state where the lever is at the connection position.

As shown in FIG. 2, the lever-type connector A includes a connector body 10, a bilaterally symmetrical lever 30 and two bilaterally symmetrical sliders 40. The connector body 10 is configured by assembling a connector housing 11 and a wire cover 20. The connector housing 11 includes a terminal accommodating portion 12 and a tubular fitting 13 surrounding both front and rear surfaces and both left and right side surfaces of the terminal accommodating portion 12. A space between the outer periphery of the terminal accommodating portion 12 and the inner periphery of the tubular fitting 13 defines a connection space 14 open in the lower surface of the connector housing 11. Female terminal fittings 15 are accommodated inside the terminal accommodating portion 12 and wires 16 fixed to upper end parts of the respective terminal fittings 15 are drawn out upward through the upper surface of the connector housing 11.

Bearings (not shown) are formed on a rear end part of the connector housing 11 for rotatably supporting the lever 30. As shown in FIGS. 3 and 4, left and right guide recesses 17 are formed in both left and right side walls of the tubular fitting 13 for guiding the bilaterally symmetrical sliders 40 in the front-rear direction (direction perpendicular to a connecting direction of the lever-type connector A and the mating connector B). Three entrance ports 18 are formed on a lower end part of each of the left and right side walls while being spaced apart in the front-rear direction and communicate with the guide recesses 17.

As shown in FIGS. 1 to 7, the wire cover 20 is mounted on the connector housing 11 to cover the upper surface (surface through which the wires 16 are drawn out) of the connector housing 11. As shown in FIGS. 11 to 14, the wire cover 20 includes a front wall 21, left and right side walls 22 and an upper wall 23 and the interior of the wire cover 20 defines a turning space 24 open in the lower and rear surfaces of the wire cover 20. The wires 16 drawn out upwardly from the connector housing 11 are turned rearward in the turning space 24 and pulled out rearwardly to the outside of the wire cover 20.

Figure 15:
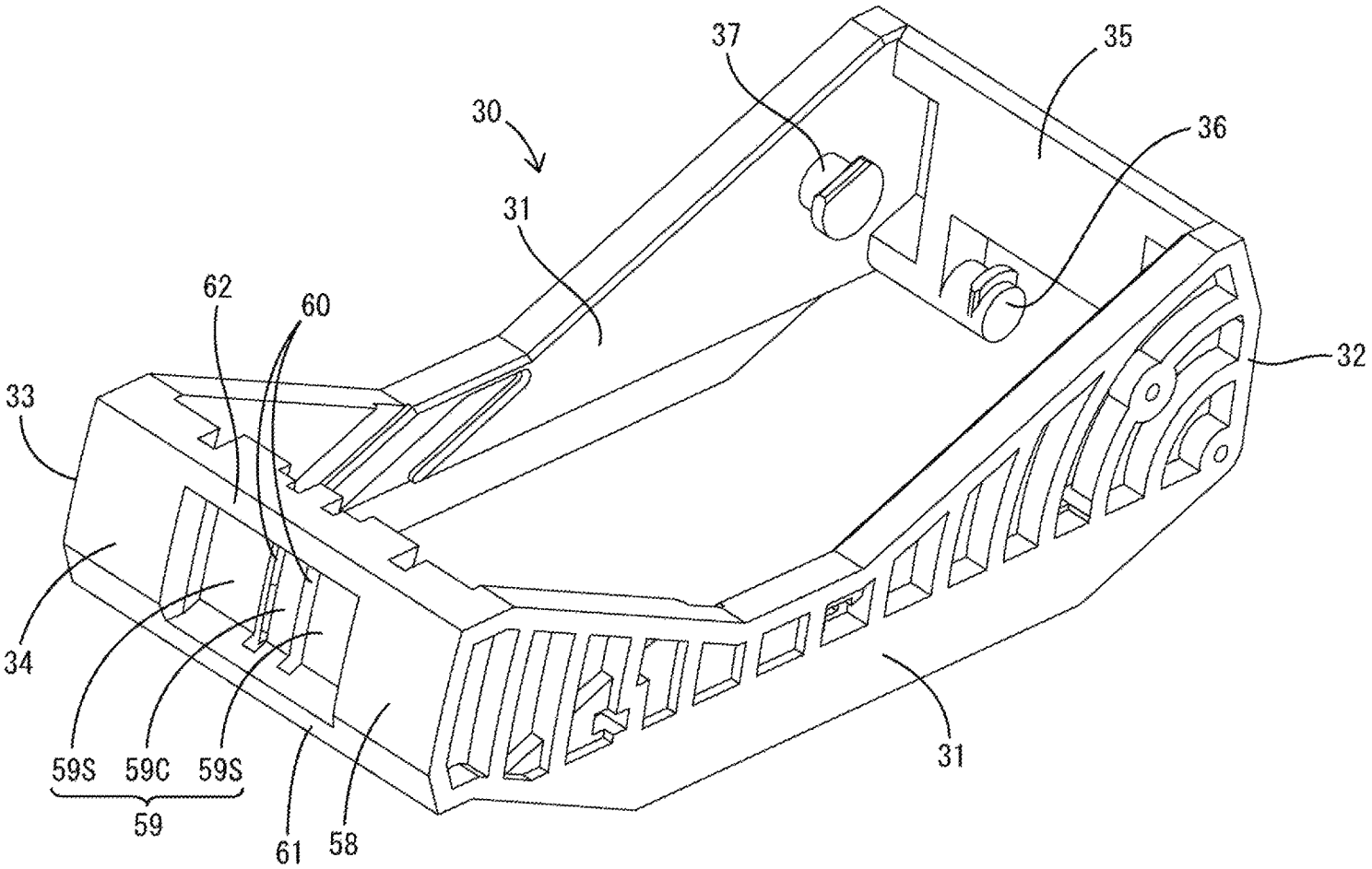
FIG. 15 is a perspective view of the lever.

As shown in FIG. 15, the lever 30 includes two arms 31 in the form of bilaterally symmetrical long plates, a coupling 35 roughly in the form of a plate that couples base ends 32 of the arms 31 and a rotating portion 34 roughly in the form of a plate coupling tips 33 of the arms 31. The lever 30 is a single component made of synthetic resin and is in the form of a rectangular frame disposed to surround the connector body 10. The coupling 35 is formed with two bilaterally symmetrical rotary shafts 36. The lever 30 is supported rotatably on the connector housing 11 by fitting the rotary shafts 36 into the bearings. The lever 30 is rotatable between an initial position (see FIG. 4) and a connection position (see FIGS. 1 to 3 and 5 to 7) about the rotary shafts 36.

The arms 31 of the lever 30 stand vertically when the lever 30 is at the initial position. At this time, the rotary shafts 36 are on a lower end part of the lever 30 and the rotating portion 34 is on an upper end part of the lever 30. When the lever 30 is at the connection position, the arms 31 are inclined to locate front ends (sides near the rotating portion 34) higher than rear ends (sides near the coupling 35).

As shown in FIGS. 3 and 4, two bilaterally symmetrical drive shafts 37 are formed at positions closer to the rotating portion 34 than the coupling 35 on the inner surfaces of the base ends 32 of the left and right arms 31. The drive shafts 37 are above and in front of the rotary shafts 36 when the lever 30 is at the connection position, but axial centers of the drive shafts 37 are located above and behind the rotary shafts 36 when the lever 30 is at the initial position. The drive shafts 37 are displaced rearward along arcuate paths in regions above the rotary shafts 36 as the lever 30 is rotated from the connection position to the initial position.

The sliders 40 are made of synthetic resin and are substantially bilaterally symmetrical flat plates whose plate thickness directions are aligned with a lateral direction. The sliders 40 are accommodated in the two guide recesses 17 of the connector housing 11 and are slidable in the front-rear direction. Two bilaterally symmetrical driven recesses 41 are formed in the inner surfaces of the sliders 40. The driven recesses 41 are disposed in rear end parts of the sliders 40 and are in the form of vertically long grooves that open in the upper end surfaces of the sliders 40. The drive shafts 37 are accommodated in the driven recesses 41 from above the sliders 40.

Relative displacements of the drive shafts 37 in the driven recesses 41 in the front-rear direction with respect to the sliders 40 are restricted, but relative vertical displacements with respect to the sliders 40 and rotation about the drive shafts 37 are enabled. By fitting the drive shafts 37 into the driven recesses 41, the sliders 40 move in parallel from an initial position to a connection position as the lever 30 is rotated from the initial position to the connection position.

Three cam grooves 42 inclined with respect to both the vertical direction (connecting direction of the lever-type connector A and the mating connector B) and the front-rear direction (sliding direction of the sliders 40) are formed in the inner surface (surface facing the connection space 14) of each of the pair of sliders 40 while being spaced apart in the front-rear direction. An entrance on a lower end part of the cam groove 42 is open in the lower end surface of the slider 40. When the lever 30 and the slider 40 are at the initial position, the entrances of the three cam grooves 42 are located to communicate with the three entrance ports 18.

The lever 30 and the sliders 40 are moved to the initial position prior to connecting the lever-type connector A and the mating connector B. In this state, as shown in FIG. 4, the terminal accommodating portion 12 is fit shallowly into the receptacle 71 and the cam followers 72 enter the entrances of the cam grooves 42. Thereafter, the rotating portion 34 of the lever 30 is gripped to rotate the lever 30 toward the connection position so that the lever 30 is displaced along the outer surface of the wire cover 20.

A distance from the rotary shafts 36 to the drive shafts 37 is shorter than a distance from the rotary shafts 36 to the rotating portion 34. Thus, the sliders 40 are moved toward the connection position with a force larger than an operating force applied to the rotating portion 34 due to a boosting action by the principle of leverage. As the sliders 40 move, the connector housing 11 is pulled toward the mating connector B by a boosting action due to the sliding contact of the cam grooves 42 and the cam followers 72. The connection of the lever-type connector A and the mating connector B is completed when the lever 30 and the sliders 40 reach the connection position, as shown in FIG. 3.

In separating the lever-type connector A and the mating connector B, as the lever 30 is rotated from the connection position to the initial position, the sliders 40 also are slid from the connection position to the initial position. Movements of the sliders 40 cause the lever-type connector A and the mating connector B to be separated by a boosting action.

The lever-type connector A includes a lock means 50 for locking the lever 30 at the connection position. As shown in FIGS. 6 to 10, the lock means 50 comprises a resilient lock piece 51 formed on the wire cover 20 (connector body 10), a resilient restricting piece 54 formed on the wire cover 20 and the rotating portion 34 of the lever 30.

The resilient lock piece 51 is a plate cantilevered down from the upper end of the front wall 21 of the wire cover 20 along the outer front surface of the front wall 21. The resilient lock piece 51 is disposed in a laterally central part of the wire cover 20, and a width (lateral dimension) thereof is smaller than a width of the front wall 21. The resilient lock piece 51 is resiliently deflectable rearwardly to approach the front wall 21. Two bilaterally symmetrical lock projections 52 are formed on the front surface (outer surface) of a lower extending end part of the resilient lock piece 51 while being spaced apart in the lateral direction.

Two bilaterally symmetrical unlocking portions 53 are formed on the front surface of the resilient lock piece 51. The unlocking portions 53 are in the form of blades (plates) long in the vertical direction (along the rotating direction when the lever 30 is rotated from the connection position toward the initial position) and project forward substantially at a right angle from the outer surface of the resilient lock piece 51. A formation range of the unlocking portions 53 in the vertical direction spans substantially the entire length of the resilient lock piece 51. The unlocking portions 53 have a roughly trapezoidal shape when viewed in a plate thickness direction (side view shape). A projecting dimension of the unlocking portion 53 from the resilient lock piece 51 is largest in a vertically central region, gradually decreases toward an upper end region while gradually decreasing toward the lower end region.

The unlocking portions 53 are disposed between the two lock projections 52 in the lateral direction (direction perpendicular to the rotating direction when the lever 30 is rotated from the connection position toward the initial position). A left part of a lower end of the left unlocking portion 53 is connected to a right part of the left lock projection 52 and a right part of a lower end of the right unlocking portion 53 is connected to a left end part of the right lock projection 52. The unlocking portions 53 are arranged while being spaced apart in the lateral direction.

The resilient restricting piece 54 is a plate cantilevered up from the lower end of the front wall 21 of the wire cover 20 along the outer surface of the front wall 21. The resilient restricting piece 54 is in the laterally central part of the wire cover 20, similar to the resilient lock piece 51, and an extending end upper end part thereof is below a lower end part of the resilient lock piece 51. The resilient restricting piece 54 is narrower than the front wall 21. The resilient restricting and is resiliently deflectable rearward toward the front wall 21. A restricting projection 55 is formed over the entire width of the resilient restricting piece 54 on the front surface of an upper end part of the resilient restricting piece 54.

Figure 8:
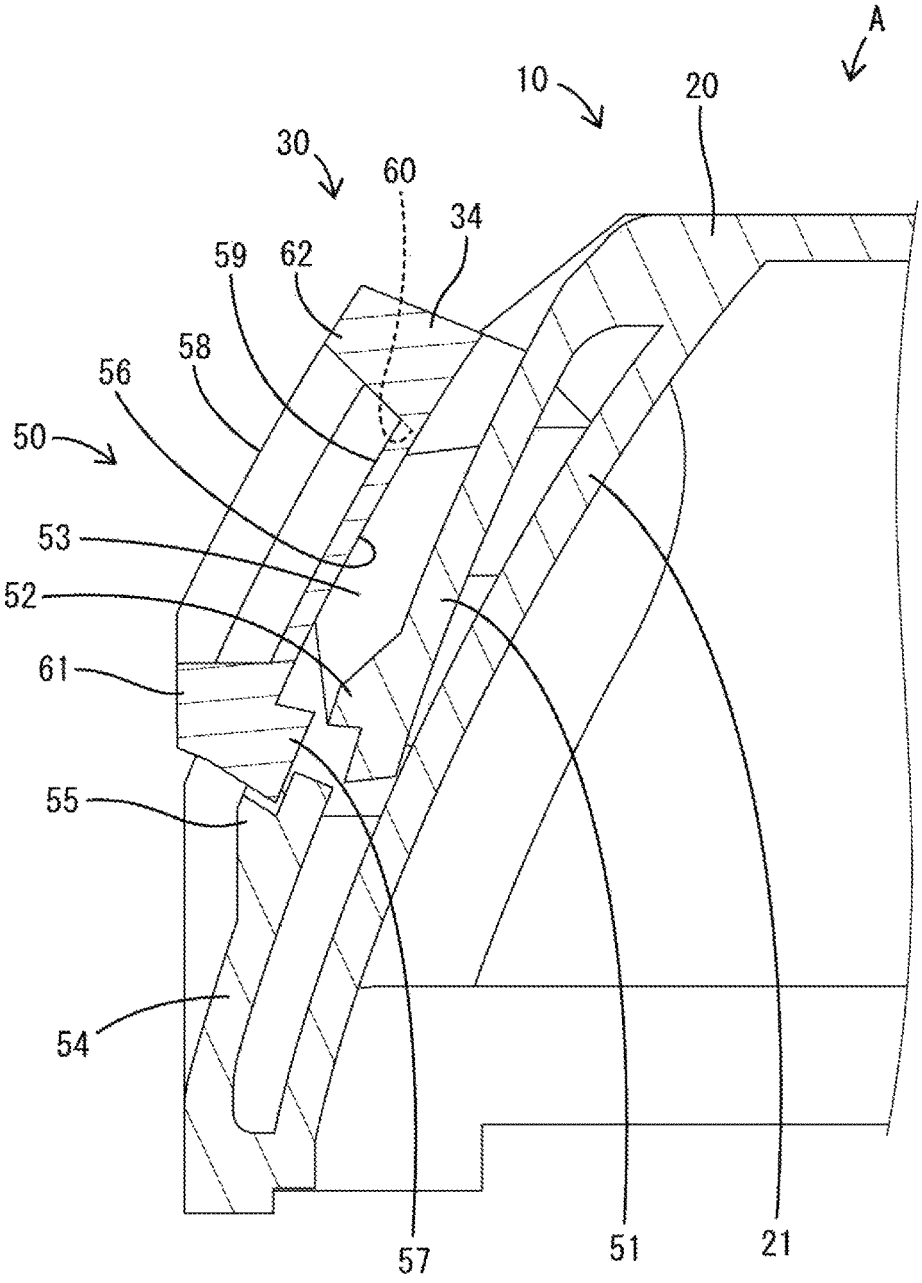
FIG. 8 is a partial enlarged section, corresponding to line X-X, showing an unlocked state where unlocking portions are pressed.
Figure 9:
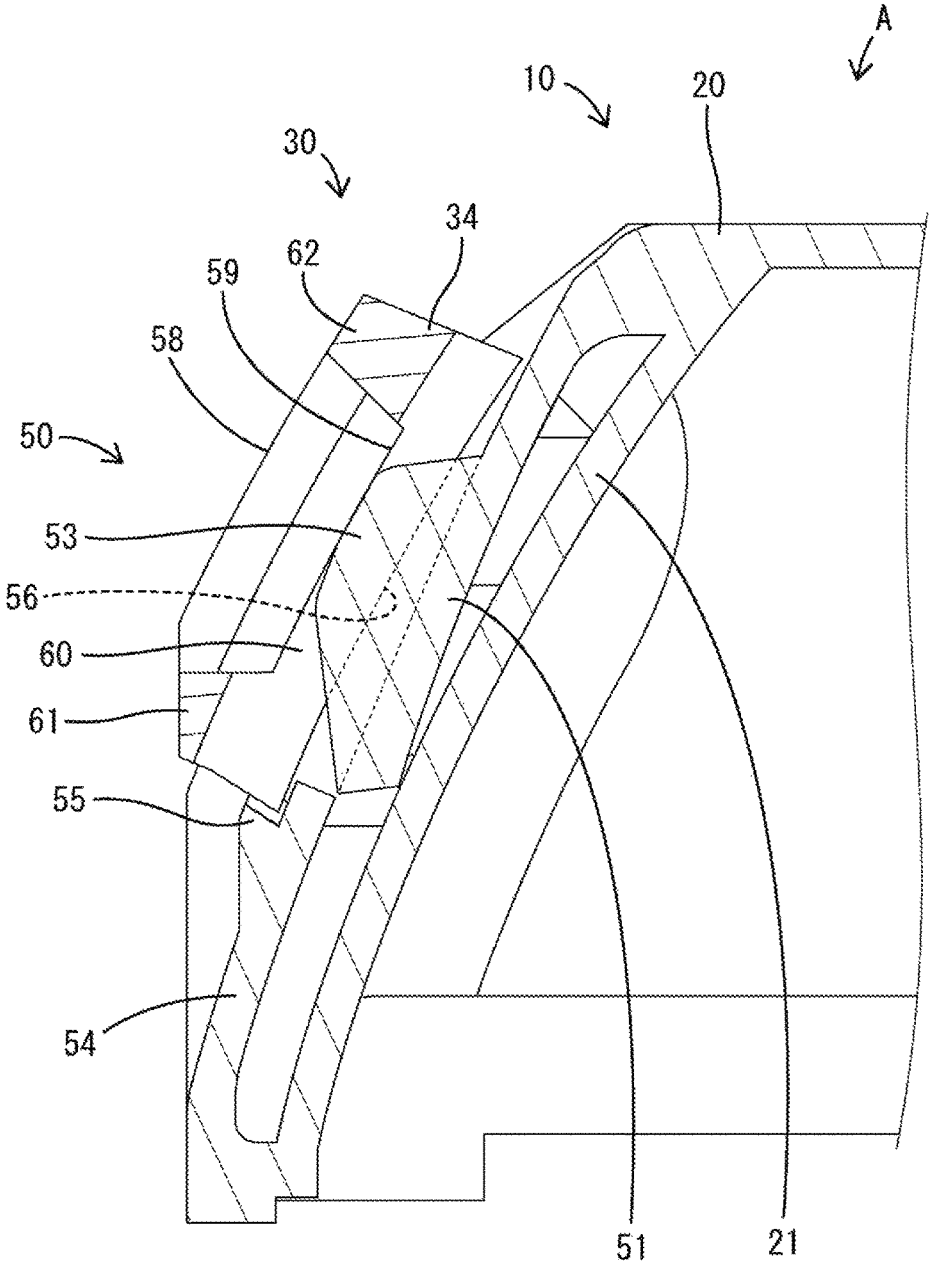
FIG. 9 is a partial enlarged section, corresponding to line Y-Y, showing the unlocked state where the unlocking portions are pressed.
Figure 10:
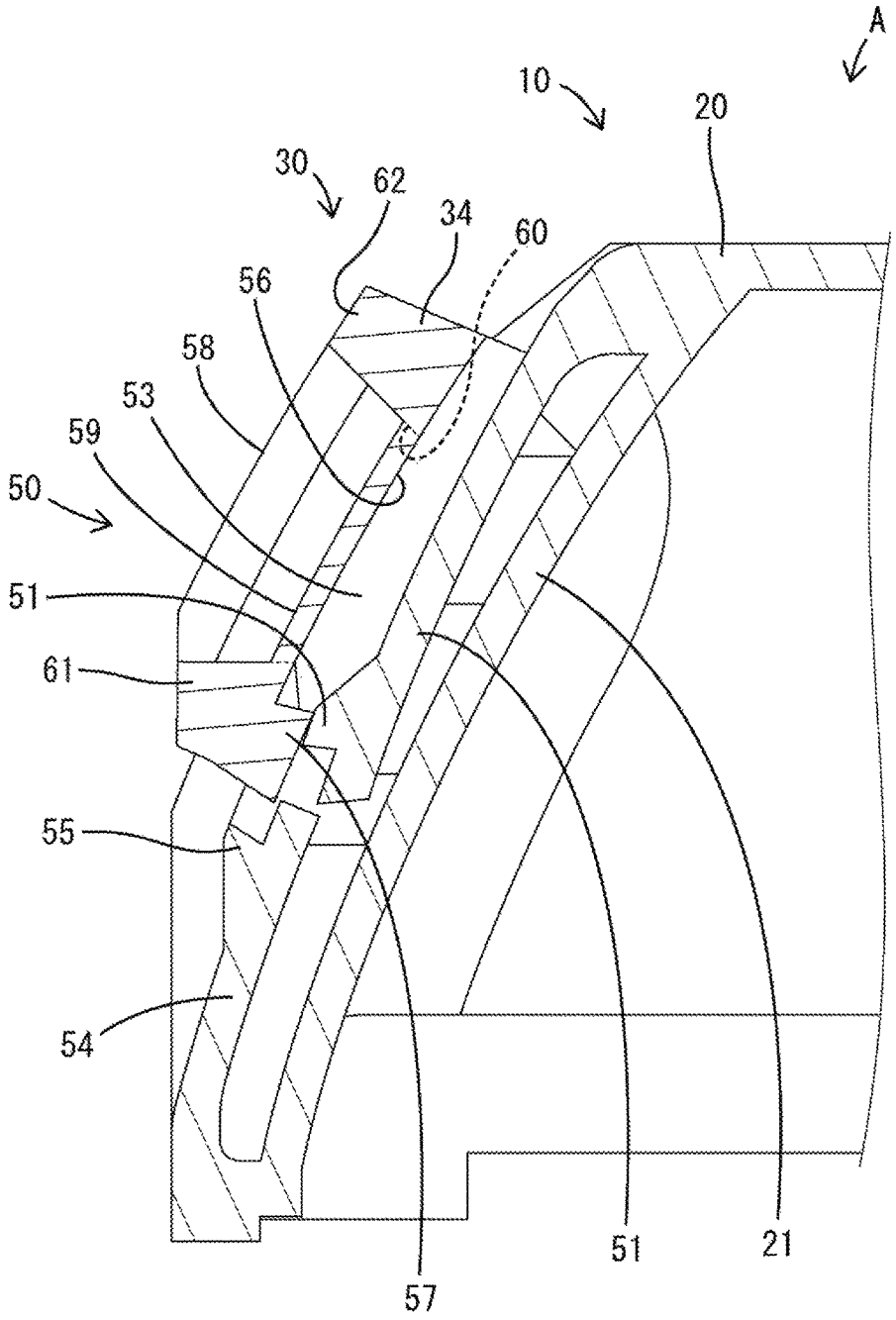
FIG. 10 is a partial enlarged section, corresponding to line X-X, showing a state where the lever starts rotating toward an initial position after unlocking.
Figure 11:
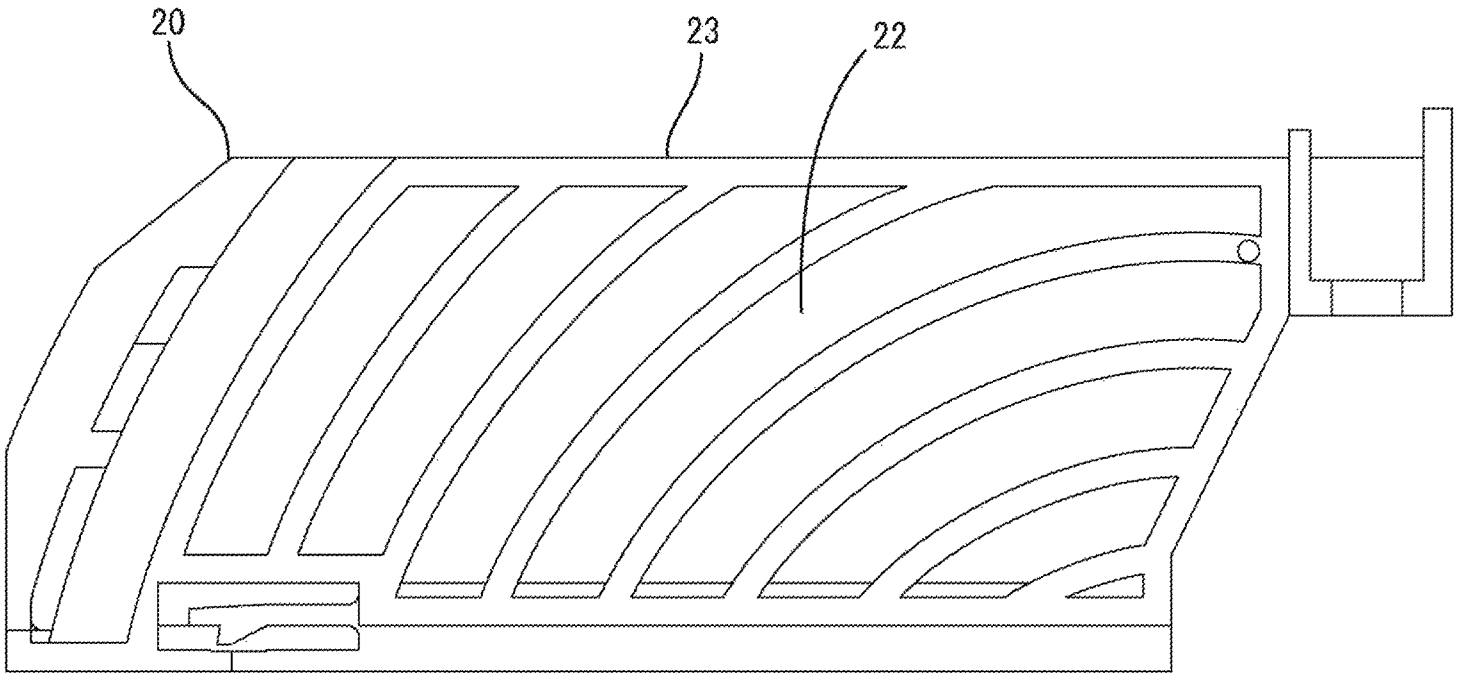
FIG. 11 is a side view of a wire cover.
Figure 12:
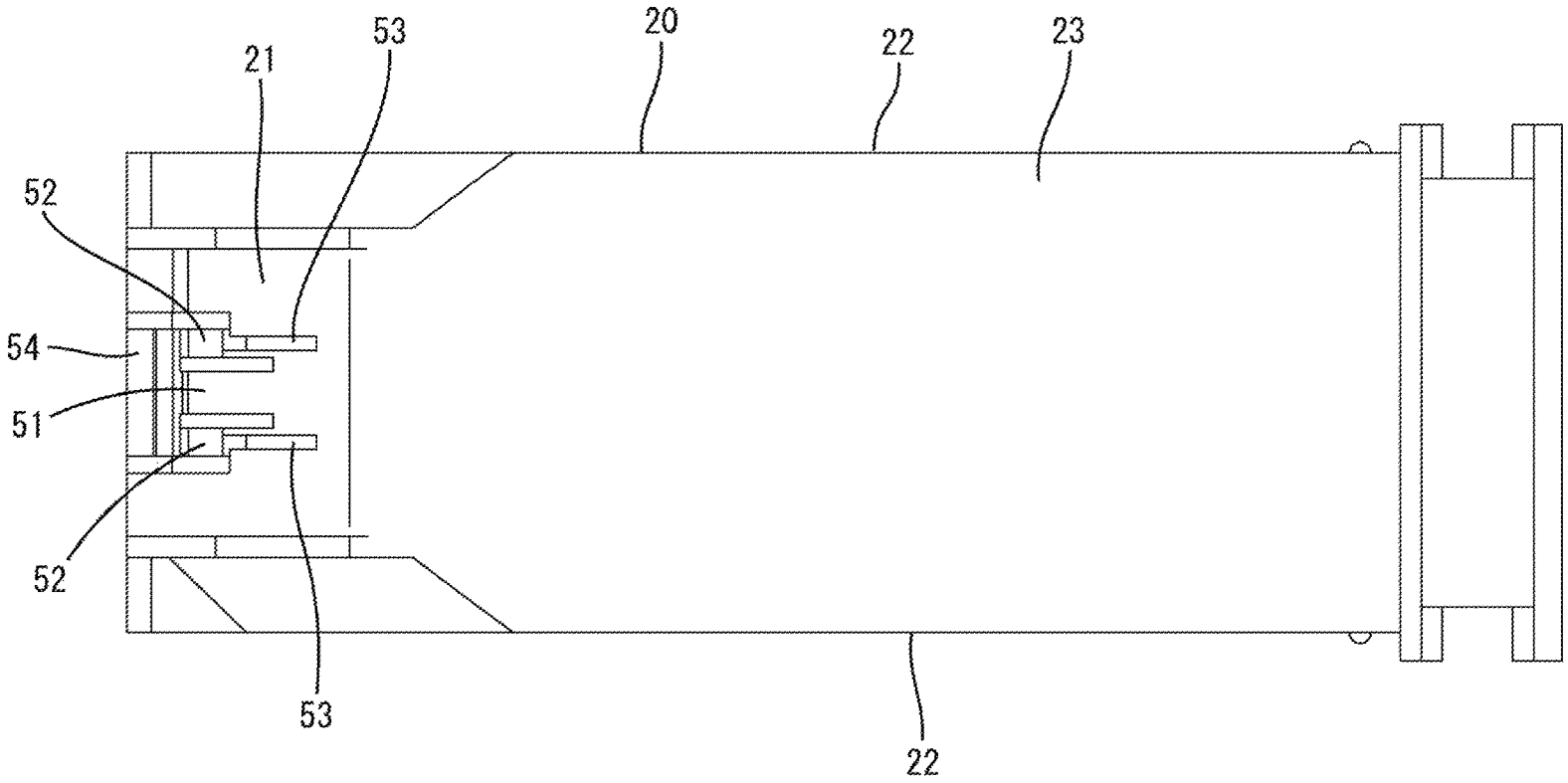
FIG. 12 is a plan view of the wire cover.
Figure 13:
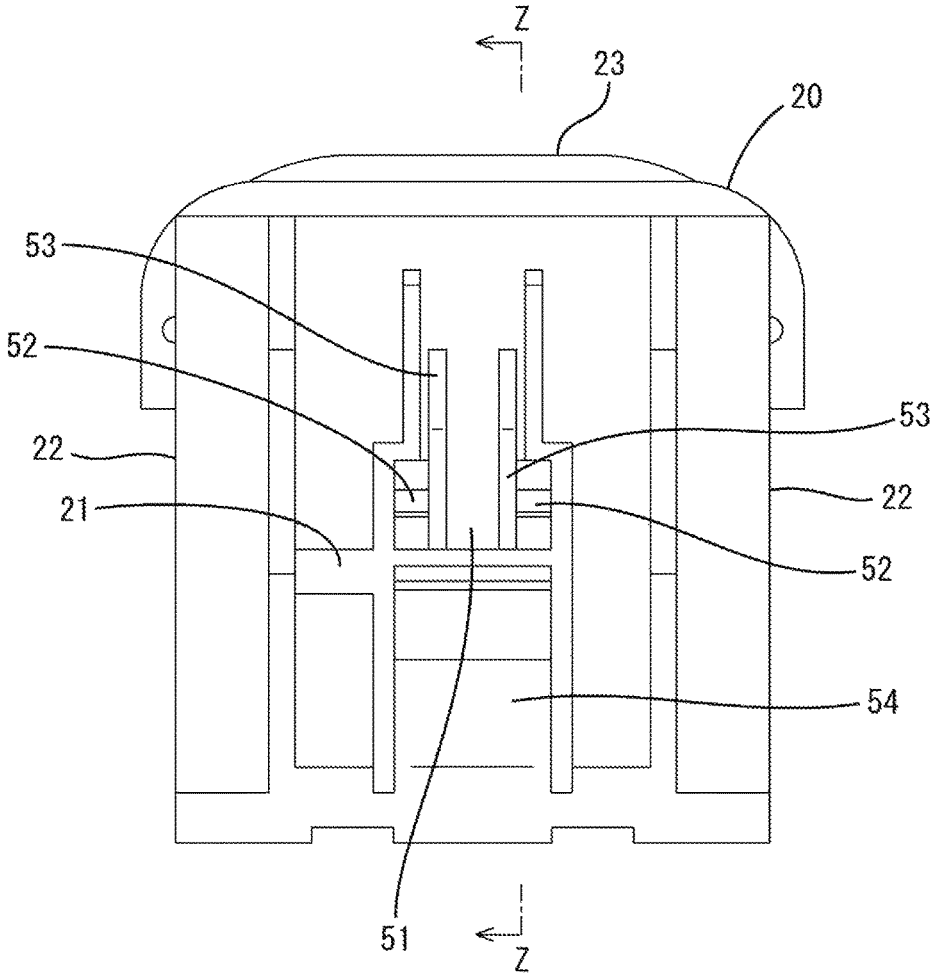
FIG. 13 is a front view of the wire cover.
Figure 14:
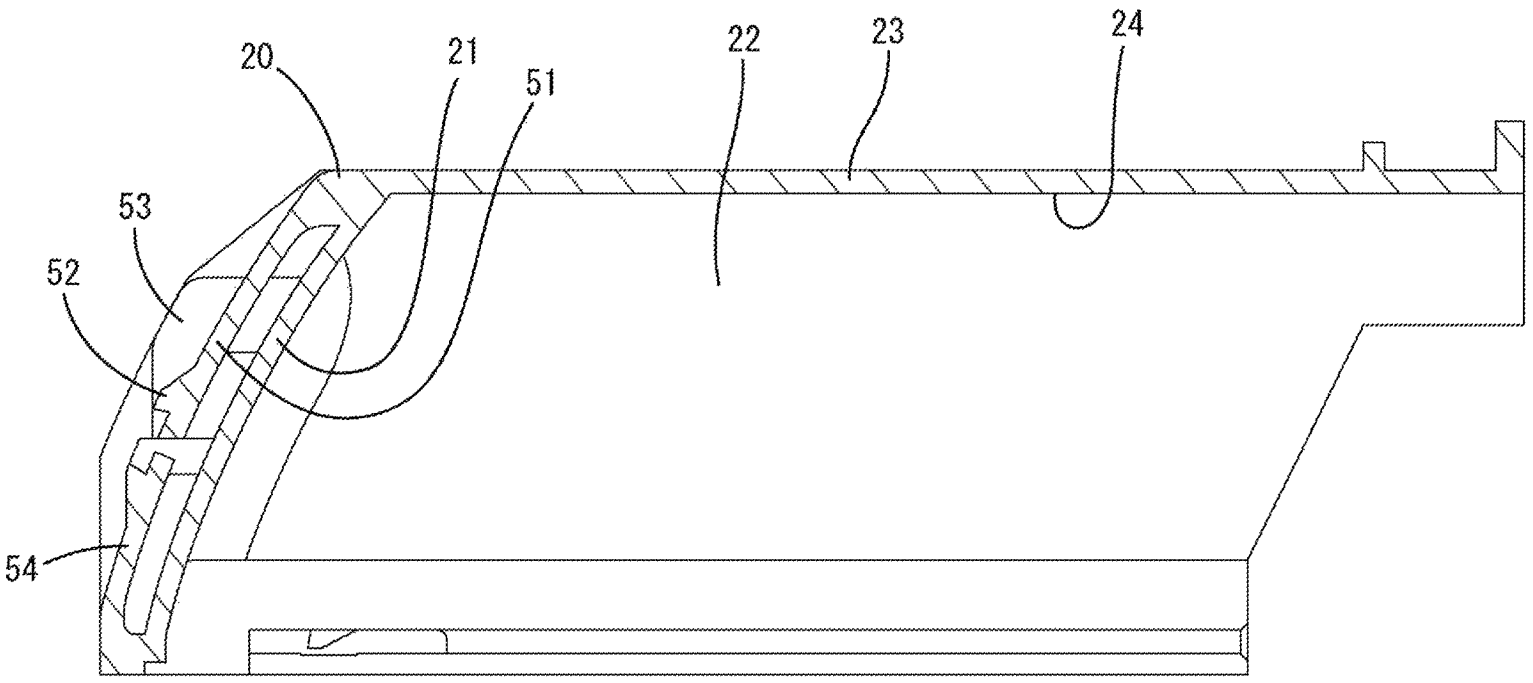
FIG. 14 is a section along line Z-Z of FIG. 13.

As shown in FIGS. 8 to 10, the rotating portion 34 is a thick plate, and a surface of the rotating portion 34 facing the rotary shafts 36 is defined as an "inner surface 56 of the rotating portion 34." The inner surface 56 of the rotating portion 34 is oriented to circumscribe a circular rotation locus of the rotating portion 34 (oriented to be substantially perpendicular to a radial direction centered on the rotary shafts 36). A locking projection 57 is formed on the inner surface 56 of the rotating portion 34. The locking projection 57 is on a front part of the inner surface 56 of the rotating portion 34 in the rotating direction of the lever 30 toward the connection position and is on a lower part of the inner surface 56 of the rotating portion 34 when the lever 30 is at the connection position.

The rotating portion 34 has an outer surface 58 opposite to the inner surface 56. The outer surface 58 of the rotating portion 34 also is oriented to circumscribe the circular rotation locus of the rotating portion 34, similar to the inner surface 56. In the process of rotating the lever 30 between the initial position and the connection position, the outer surface 58 of the rotating portion 34 constantly is exposed to outside. A laterally central part of the outer surface 58 of the rotating portion 34 has a substantially rectangular recess to form a rectangular finger placing surface 59. A width of the finger placing surface 59 is larger than those of the resilient lock piece 51 and the resilient restricting piece 54.

The rotating portion 34 is formed with two bilaterally symmetrical through holes 60. The through holes 60 are slits long and narrow in the vertical direction and penetrate from the inner surface 56 of the rotating portion 34 to the finger placing surface 59 so that the through holes 60 are open in the finger placing surface 59. A formation range of the through holes 60 in the vertical direction spans roughly over the entire region of the finger placing surface 59 in the vertical direction. The through holes 60 are arranged to correspond to the unlocking portions 53 in the lateral direction.

An area of the finger placing surface 59 is dimensioned to be coverable with a part of a thumb closer to a tip than a first joint. The finger placing surface 59 is divided laterally into three regions with the through holes 60 as boundaries. Specifically, the finger placing surface 59 is composed of a central contact surface 59C between the through holes 60 and two side contact surfaces 59S located at both sides of the central contact surface 59C.

A formation range of the finger contact surface 59 in the vertical direction is a region of the outer surface 58 of the rotating portion 34 excluding upper and lower end parts. A region of the rotating portion 34 below the finger contact surface 59 serves as a connection finger placing portion 61 relatively projecting toward the outer surface 58 with respect to the finger contact surface 59. In connecting the lever-type connector A and the mating connector B, a worker rotates the lever 30 from the initial position to the connection position by placing his finger on the connection finger placing portion 61. A region of the rotating portion 34 above the finger contact surface 59 serves as a separation finger placing portion 62 relatively projecting toward the outer surface 58 with respect to the finger contact surface 59. In separating the lever-type connector A and the mating connector B, the worker rotates the lever 30 from the connection position to the initial position by placing his finger on the separation finger placing portion 62.

Figure 6:
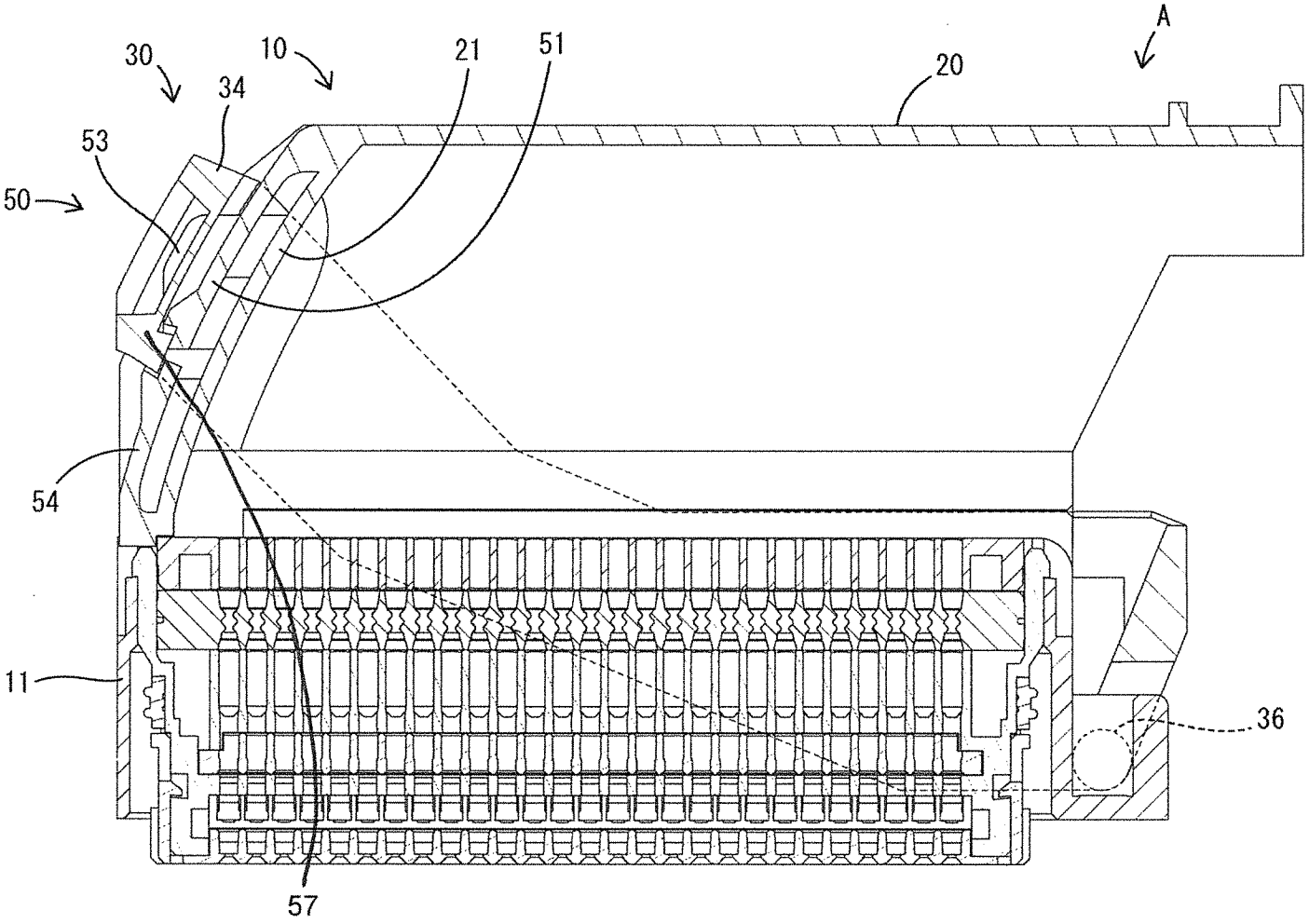
FIG. 6 is a section along line X-X of FIG. 5.

With the lever 30 located at the connection position, the locking projection 57 of the rotating portion 34 is locked to the lock projections 52 of the resilient lock piece 51 as shown in FIG. 6, thereby restricting the rotation of the lever 30 toward the initial position. Likewise, with the lever 30 located at the connection position, the locking projection 57 is locked to the restricting projection 55 of the resilient restricting piece 54, thereby restricting the rotation of the lever 30 to a side opposite to the initial position. By this locking of the resilient lock piece 51 and the resilient restricting piece 54, the lever 30 is locked in a rotation restricted state at the connection position. In this state, the resilient lock piece 51 and the resilient restricting piece 54 are not resiliently deformed.

Figure 5:
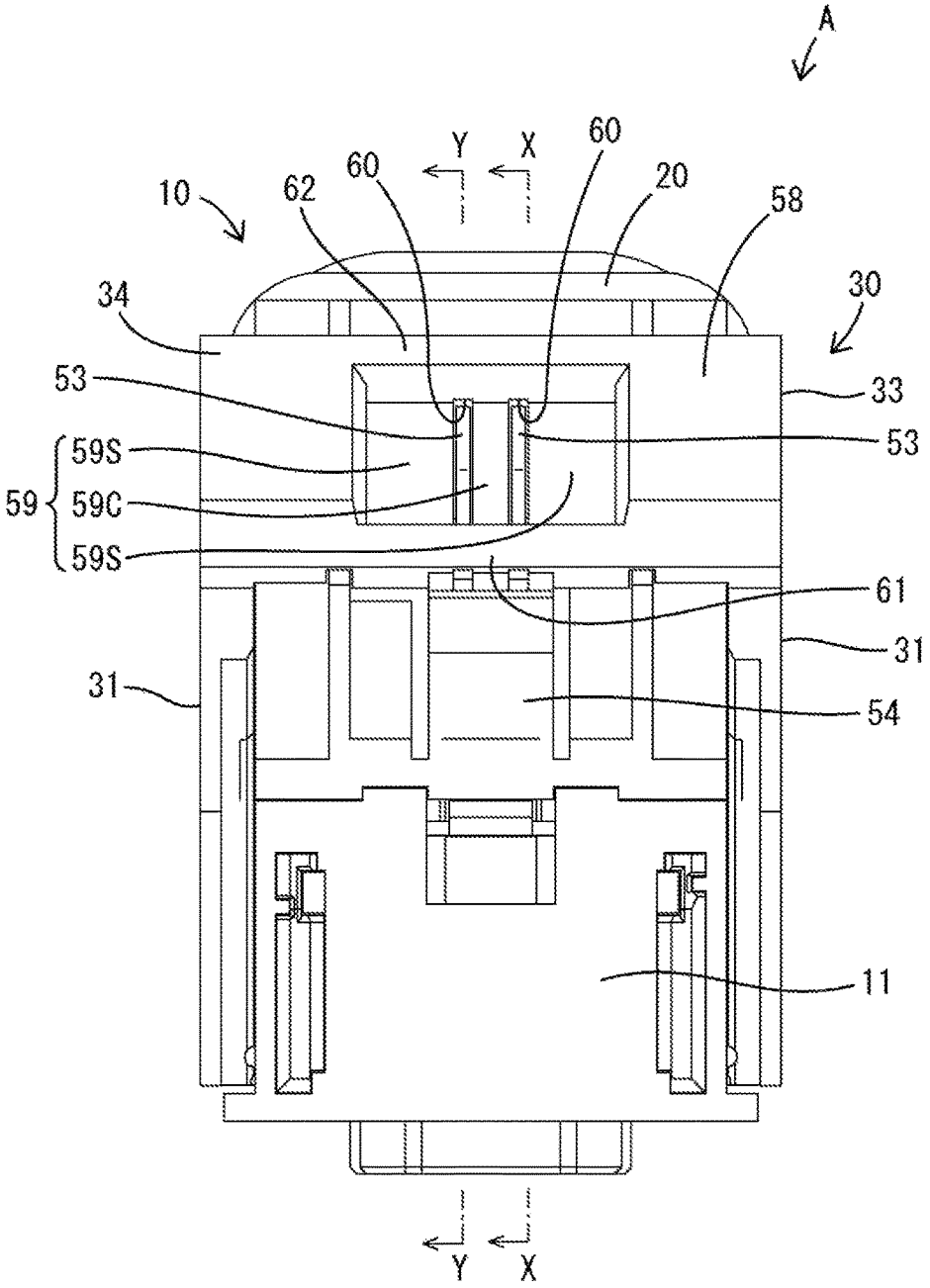
FIG. 5 is a front view showing the state where the lever is at the connection position.
Figure 7:
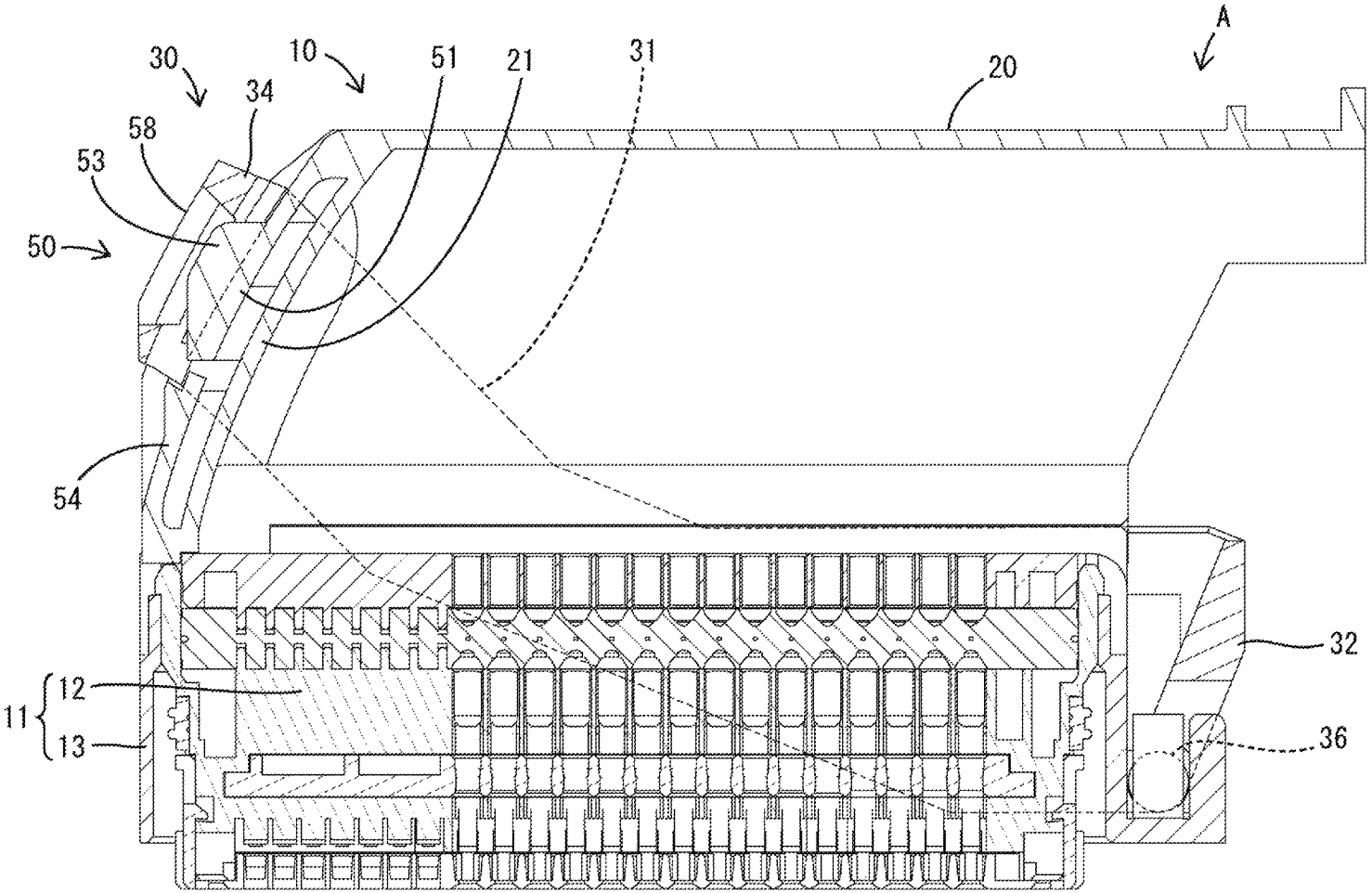
FIG. 7 is a section along line Y-Y of FIG. 5.

With the lever 30 locked at the connection position, the rotating portion 34 is located to substantially entirely cover the resilient lock piece 51 as shown in FIGS. 5 and 6. Thus, the resilient lock piece 51 is protected from the interference of external matters by the rotating portion 34. Further, as shown in FIGS. 6 and 7, the pair of unlocking portions 53 projecting forward from the resilient lock piece 51 enter the pair of through holes 60 from the side of the inner surface 56 of the rotating portion 34 and projecting end parts thereof project further forward than the finger contact surface 59. When the rotating portion 34 is viewed from front, the pair of unlocking portions 53 are exposed on the finger contact surface 59 of the outer surface 58 of the rotating portion 34 as shown in FIG. 5. Further, the pair of unlocking portions 53 and the central contact surface 59C and the pair of side contact surfaces 59S constituting the finger contact surface 59 are alternately arranged adjacent to each other in the lateral direction (direction intersecting with the rotating direction of the lever 30).

In separating the lever-type connector A and the mating connector B, the worker starts pressing the pair of unlocking portions 53 (unlocking operation) using any one finger. When the finger pressing the unlocking portions 53 contacts the finger contact surface 59 and the separation finger placing portion 62, the unlocking operation is completed and the projecting end parts of the unlocking portions 53 projecting forward from the finger contact surface 59 are accommodated into the through holes 60 as shown in FIG. 9. When the unlocking portions 53 are pressed, the resilient lock piece 51 is resiliently deformed away from the rotating portion 34 and, as shown in FIG. 8, the lock projections 52 are retracted toward the front surface wall 21 and separated from the locking projection 57 of the rotating portion 34 to be unlocked. In this way, the rotation of the lever 30 toward the initial position is allowed.

In the unlocked state, the projecting end edges of the pair of unlocking portions 53 resilient come into contact with the finger in contact with the finger contact surface 59 and the lower surface of the separation finger placing portion 62 due to a resilient restoring force of the resilient lock piece 51. From this state, a rotational operation force is applied to the lever 30 with the finger held in contact with the finger contact surface 59 and the separation finger placing portion 62. This rotational operation force is generated by frictional resistance between the finger and the finger contact surface 59 in addition to by the placement of the finger on the separation finger placing portion 62.

When the rotational operation force is applied to the lever 30, the lever 30 starts rotating toward the initial position. Here, since the pair of unlocking portions 53 are exposed on the finger contact surface 59 and adjacent to the finger contact surface 59 and the unlocking portions 53 in the direction intersecting with the rotating direction of the lever 30, the pair of unlocking portions 53 are maintained in the unlocked state by being pressed with the finger when the rotation of the lever 30 is started. Since the unlocked state is maintained also immediately after the rotation of the lever 30 is started, the locking projection 57 is located on the lock projections 52 as shown in FIG. 10. In this state, even if the finger is separated from the unlocking portions 53, the rotation of the lever 30 is not restricted by the resilient lock piece 51 (lock projections 52).

The lever-type connector A includes the connector body 10 and the lever 30. The lever 30 is rotatably supported on the connector body 10 on the base end portion 32 thereof, and the rotating portion 34 for rotational operation is formed on the tip portion 33 of the lever 30. The finger contact surface 59 with which a finger is brought into contact at the time of the rotational operation is disposed on the outer surface 58 of the rotating portion 34. The connector body 10 is formed with the resilient lock piece 51 configured to lock the lever 30 in the rotation restricted state by being locked to the lever 30, and the resilient lock piece 51 is formed with the unlocking portions 53 configured to press the resilient lock piece 51 in a direction separating from the lever 30.

In a state where the resilient lock piece 51 and the lever 30 are locked to each other and the lever 30 is locked at the connection position, the unlocking portions 53 are exposed on the outer surface 58 of the lever 30. That is, the unlocking portions 53 are disposed on the outer surface 58 of the rotating portion 34 similarly to the finger contact surface 59. Further, the central contact surface 59C and the pair of side contact surfaces 59S constituting the finger contact surface 59 and the unlocking portions 53 are alternately arranged adjacent to each other in the lateral direction intersecting with the rotating direction of the lever 30. According to this configuration, the unlocking portions 53 can be pressed to hold the unlocked state with the finger held in contact with the finger contact surface 59. Since there is no possibility of relaxing the force pressing the unlocking portions 53 when a transition is made from the unlocking operation to the operation of rotating the lever 30, operability is excellent.

Further, in the state where the resilient lock piece 51 and the lever 30 are locked to each other and the lever 30 is locked at the connection position, the pair of unlocking portions 53 project through the through holes 60 open in the finger contact surface 59. This configuration means that the unlocking portions 53 are adjacent to the central contact surface 59C and the pair of side contact surfaces 59S of the finger contact surface 59. Thus, when a transition is made from the unlocking operation to the operation of rotating the lever 30, the force pressing unlocking portions 53 is unlikely to be relaxed and locking is reliably released.

Further, the unlocking portions 53 are in the form of blades extending along the rotating direction of the lever 30. According to this configuration, when the lever 30 is rotated while the unlocking portions 53 are pressed with one finger, frictional resistance between the blade-shaped unlocking portions 53 and the finger is small. Since the finger pressing the unlocking portions 53 can slide in the rotating direction while being kept in that pressing state without being subjected to resistance, operability is good.

Further, the finger contact surface 59 is a substantially flat surface extending along the rotating direction of the lever 30 or an arcuate surface having a large radius of curvature. Since a contact area between the finger contact surface 59 and the finger is larger than that between the blade-like unlocking portions 53 and the finger, frictional resistance between the finger contact surface 59 and the finger is larger than that between the unlocking portions 53 and the finger. Since this makes it difficult for the finger to slip with respect to the finger contact surface 59, operability when the rotation of the lever 30 is started is good.

The invention is not limited to the embodiment described above with reference to the drawings. For example, the following embodiments also are included in the scope of the invention.

Although the rotating portion is formed with the separation finger placing portion and the connection finger placing portion in the above embodiment, the rotating portion may not include at least one of the separation finger placing portion and the connection finger placing portion.

Although the unlocking portions project through the through holes in the finger contact surface with the resilient lock piece and the lever locked to each other in the above embodiment, the through holes may not be formed and the unlocking portions may be disposed along the outer peripheral edge of the finger contact surface.

Although the unlocking portions and the finger contact surface are disposed adjacent to each other in the direction intersecting with the rotating direction of the lever with the resilient lock piece and the lever locked to each other in the above embodiment, the unlocking portions and the finger contact surface may be disposed adjacent to each other in the rotating direction of the lever.

Although the unlocking portions are in the form of blades extending along the rotating direction of the lever in the above embodiment, the unlocking portions may be in the form of projecting blocks.

Although the finger contact surface is a substantially flat surface extending along the rotating direction of the lever in the above embodiment, the finger contact surface may be a substantially flat surface largely inclined with respect to the rotating direction of the lever or a curved surface.

Although the rotating portion is disposed to cover the resilient lock piece with the resilient lock piece and the lever locked to each other in the above embodiment, the resilient lock piece may be exposed side by side with the rotating portion on the outer surface of the connector body.

Although the resilient lock piece is formed on the wire cover in the above embodiment, the resilient lock piece may be formed on the connector housing.

Although the pair of left and right unlocking portions are provided in the above embodiment, only one, three or more unlocking portions may be provided.

Although the sliders movable in conjunction with the rotation of the lever are provided in the above embodiment, the first aspect of the invention can be also applied to lever-type connectors including no slider.

Although the finger contact surface and the unlocking portions are disposed on the outer surface of the rotating portion in the above embodiment, the unlocking portions may be disposed at positions deviated from the outer surface of the rotating portion.

LIST OF REFERENCE SIGNS

A . . . lever-type connector
10 . . . connector body
30 . . . lever
32 . . . base end portion of lever
33 . . . tip portion of lever
34 . . . rotating portion
51 . . . resilient lock piece
53 . . . unlocking portion
58 . . . outer surface of rotating portion
59 . . . finger contact surface
60 . . . through hole

What is claimed is:

1. A lever-type connector, comprising:

a connector body;

a lever having a base end rotatably supported on the connector body and a rotating portion for rotational operation formed on a tip portion thereof;

a finger contact surface disposed on an outer surface of the rotating portion, a separation finger placing portion projecting from the outer surface of the rotating portion in a direction opposite the base end of the lever and, and at least one through hole formed in the finger contact surface;

a resilient lock piece cantilevered integrally from a surface of the connector body and configured to lock the lever in a rotation restricted state by being locked to the lever; and an unlocking portion formed integrally on the resilient lock piece and configured to press the resilient lock piece in a direction separating from the lever, the unlocking portion projecting through the through hole in the finger contact surface and exposed on the outer surface of the lever with the resilient lock piece and the lever locked to each other, wherein the finger contact surface and separation finger placing portion are configured so that a finger brought into contact with the finger contact surface and the unlocking portion projecting through the through hole contacts the separation finger placing portion to disengage the resilient lock piece and rotate the lever into an open position.

2. The lever-type connector of claim 1, wherein the unlocking portion and the finger contact surface are disposed adjacent to each other in a direction intersecting with a rotating direction of the lever with the resilient lock piece and the lever locked to each other.

3. The lever-type connector of claim 2, wherein the unlocking portion is in the form of a blade extending along a rotating direction of the lever.

4. The lever-type connector of claim 3, wherein the finger contact surface is a substantially flat surface extending along the rotating direction of the lever.

5. The lever-type connector of claim 4, wherein the rotating portion is disposed to cover the resilient lock piece when the resilient lock piece and the lever locked to each other.

6. The lever-type connector of claim 1, wherein the unlocking portion and the finger contact surface are disposed adjacent to each other in a direction intersecting with a rotating direction of the lever with the resilient lock piece and the lever locked to each other.

7. The lever-type connector of claim 6, wherein the unlocking portion is in the form of a blade extending along a rotating direction of the lever.

8. The lever-type connector of claim 7, wherein the finger contact surface is a substantially flat surface extending along the rotating direction of the lever.

9. The lever-type connector of claim 6, wherein the rotating portion is disposed to cover the resilient lock piece when the resilient lock piece and the lever locked to each other.

10. The lever-type connector of claim 1, wherein the unlocking portion is in the form of a blade extending along a rotating direction of the lever.

11. The lever-type connector of claim 10, wherein the finger contact surface is a substantially flat surface extending along the rotating direction of the lever.

12. The lever-type connector of claim 11, wherein the rotating portion is disposed to cover the resilient lock piece when the resilient lock piece and the lever locked to each other.

13. The lever-type connector of claim 10, wherein the rotating portion is disposed to cover the resilient lock piece when the resilient lock piece and the lever locked to each other.

14. The lever-type connector of claim 1, wherein the rotating portion is disposed to cover the resilient lock piece when the resilient lock piece and the lever locked to each other.

15. The lever-type connector of claim 1, wherein the resilient lock piece is cantilevered integrally from two locations of a surface of the connector body.

16. The lever-type connector of claim 1, comprising:

a connection finger placing portion projecting from the outer surface of the rotating portion at a position facing the separation finger placing portion with the finger contact surface disposed between the connection finger placing portion and the separation finger placing portion, wherein a finger brought into contact with the contact surface bears against the connection finger placing portion when the lever is rotated to a closed position.

* * * * *